United States Patent [19]

Coombs et al.

[11] 4,298,456

[45] Nov. 3, 1981

[54] OIL PURIFICATION BY DEASPHALTING AND MAGNETO-FILTRATION

[75] Inventors: Daniel M. Coombs; Dwight D. Boesiger, both of Bartlesville, Okla.

[73] Assignee: Phillips Petroleum Company, Bartlesville, Okla.

[21] Appl. No.: 171,202

[22] Filed: Jul. 22, 1980

[51] Int. Cl.[3] ..... C10G 32/02

[52] U.S. Cl. ..... 208/86; 208/88; 208/251 R; 210/695

[58] Field of Search ..... 208/251 R, 86, 88; 210/695, 634

[56] References Cited

U.S. PATENT DOCUMENTS

| | | | |
|---|---|---|---|
| 2,727,853 | 12/1955 | Hennig | 208/86 |
| 3,227,645 | 1/1966 | Frumkin et al. | 208/251 R |
| 3,379,639 | 4/1968 | Vallino | 208/251 R |
| 4,054,513 | 10/1977 | Windle | 209/214 |

*Primary Examiner*—Delbert E. Gantz
*Assistant Examiner*—Olik Chaudhuri

[57] ABSTRACT

Demetallized hydrocarbon feedstock is obtained from heavy oils by first solvent extracting the heavy oils and then demetallizing the extract in a magneto-filtration step. In another embodiment, diamagnetic nickel complexes in hydrocarbon oils are first converted to a paramagnetic product and the oil stream thereafter is passed through a magneto-filtration operation.

16 Claims, 2 Drawing Figures

OIL PURIFICATION BY DEASPHALTING AND MAGNETO-FILTRATION

The present invention relates to the purification of oils. More specifically, the present invention relates to the removal of metals from metals containing oils.

The crude oil supply has become very tight in recent years. Clean crude oils are not as plentiful and as available as they used to be and their price has skyrocketed. The oil industry is therefore forced to use heavier crudes and petroleum residues as the feedstock for various operations. These feedstocks usually contain higher contents of contaminating metals and sulfur. The high metal content of heavy crude oils and petroleum residues is particularly undesirable in view of the detrimental effects of these metals on various catalysts used in various petroleum treatment processes. As an example, metals such as vanadium, nickel and iron present in oil feedstocks used for catalytic cracking processes in the absence of added hydrogen cause increased production of hydrogen and coke and result in reduced yield of gasoline as compared to similar operations in the absence of such metals.

Various procedures have been proposed in the art to mitigate the undesirable effects of metals in such heavier oil feedstocks. One suggestion is to remove the metals. Another suggestion is to passivate the metals. There is a continuing demand in the petroleum technology for a simple and efficient operation allowing the removal of metals from metal contaminated oil feedstocks.

THE INVENTION

It is one object of this invention to provide a process for removing metals from oils containing such metals.

Another object of this invention is to provide a process for producing a clean hydrocarbon feedstock from heavy oil feedstocks such as heavy crudes and petroleum residues.

A yet further object of this invention resides in the provision of a process for removing metals from metal containing oils.

These and other objects, advantages, details, features and embodiments of this invention will become apparent to those skilled in the art from the following detailed description, the attached claims and the drawing which shows a schematic flow diagram of an operation carrying out the process of this invention.

In accordance with this invention a process for demetallizing a heavy oil stream is provided for which comprises a solvent extraction step followed by a magneto-filtration step. In the solvent extraction step a significant portion of the metals together with asphaltenes is removed from the heavy oil stream. The thus prepurified stream is thereafter considerably reduced in its metal content by a magneto-filtration step to be described in detail in the following.

Thus, in accordance with a first embodiment of this invention a process for demetallizing a heavy oil stream is provided. The heavy oil stream contains metal in either a magnetizable form of paramagnetic molecules or paramagnetic particles or ferromagnetic particles or in the form of molecules or particles convertible to such magnetizable forms. The heavy oil stream is first contacted with a light solvent stream to obtain an extraction mixture. This extraction mixture is then separated into an extract stream which comprises the solvent, extracted hydrocarbon and some metals in the magnetizable form described and into a residue stream which has a high content of metals also in the magnetizable form described above. The extract stream then is subjected to a magneto-filtration step to obtain a demetallized extract stream. This demetallized extract stream thereafter can be used in conventional downstream petroleum refining operations such as a catalyst cracking operation.

In order to also remove the not yet magnetizable particles or molecules from the oil stream it is contemplated within the process just described to convert these molecules/particles into the magnetizable form of either paramagnetic molecules or ferromagnetic particles prior to subjecting the extract streams to the magneto-filtering step.

In a preferred variation of the first embodiment of this invention the demetallized extract stream is separated into a solvent stream and an oil stream. This oil stream then is further used in downstream petroleum operations such as catalytic cracking whereas the solvent stream is preferably used in the upstream step of producing the extraction mixture. The separation of the extract stream is advantageously carried out in two steps, namely in a phase separation and a solvent stripping step. In the phase separation step the extract stream is phase separated into a lean solvent stream and a rich extract stream. In the solvent stripping step the rich extract stream is then subjected to solvent stripping in an overhead solvent stream and the bottom oil stream. The lean solvent stream from the phase separation step is preferably used in the solvent extraction step upstream.

The residue stream obtained in the solvent extraction step in accordance with another variation of the process of this invention is introduced into a coking operation as at least a portion of the feedstock of such a coking step. This feedstock is converted into coke, hydrocarbon products and metal rich ashes as the product of the process. In addition to coking the following other methods can be applied to the bottoms: While a coking operation is one well known process for handling the bottoms (residue, raffinate), it is likely that in application viable alternatives would be (1) combustion; either straight or mixed with other fuels such as coke to recover the fuel value and a high metals ash for metals recovery, (2) gasification to produce either a clean fuel gas or ultimately for hydrogen production again the ash would have high potential for metals recovery, (3) flash hydropyrolysis to produce methane and other light hydrocarbon gases, benzene-toluene-xylene liquids, and char. The char could then be gasified as per (2) above.

To optimize the energy budget in the overall process it is preferred to pass the solvent stream through indirect heat exchange relationship with the extraction mixture. Using two or more magneto-filtration units it is possible to operate essentially in an uninterrupted manner switching back and forth between the magneto-filtration units and employing these units alternatingly in a filtration mode and a cleaning or regeneration mode. The extract stream is thus passed for a first period of time through a first magneto-filtration unit under magneto-filtration conditions and thereafter the extract stream is passed through a second magneto-filtration unit also under magneto-filtration conditions. Washing fluid is passed through the magneto-filtration filters while no extract stream is flowing through these filters and while these filters are not under magneto-filtration conditions. Thereby the accumulated metals from these filters are removed together with the washing fluid and the magneto-filtration units are thereby regenerated for repeating the filtration steps. A metal-wash fluid is obtained. The wash fluid used is preferably the same material as the light solvent used for the solvent extraction step. Furthermore, it is advantageous to subject the metal rich wash fluid to a separation step wherein a lean wash fluid is recovered as well as a stream of wash fluid residue which is rich in metals. The lean wash fluid is recycled to the filter cleaning operation whereas the wash fluid residue advantageously is further used in a coking operation as at least a portion of the feedstock. The wash fluid residue rich in metals is converted into coke, hydrocarbon products and metal rich ashes as the product of this step.

In accordance with a second embodiment of this invention diamagnetic contaminations are removed from an oil feedstock by first converting the diamagnetic contaminations to paramagnetic forms and thereafter subjecting the thus treated oil to a magneto-filtration step. This separate procedure which—as indicated above—can also be used in conjunction with the first embodiment of this invention—has the significant advantage of generating oil feedstocks which are reduced in metals content even with respect to those metals that are present as a contamination in diamagnetic form which is per se not susceptible to direct magneto-filtration removal.

Nickel contaminations are typically present as nickel complexes in oil which are diamagnetic. These nickel compounds can be converted to the paramagnetic form. One method of such a conversion is to subject the nickel compound to the reaction with a composition selected from the group consisting of acids or nucleophilic solvents. In this process the coordination number of nickel is changed from 4 to 6. The iron and vanadium in the metals compounds in the oil are present in the paramagnetic or ferromagnetic state and, therefore, can be removed from the oil by means of a magneto-filtration unit. Nickel in the nickel compounds in the oil, however, is usually present in the diamagnetic state and must be converted to the paramagnetic state in order to be removed from the oil by means of magneto-filtration. In some oils, however, the nickel and the vanadium may be complexed in the same colloid. When this occurs, the diamagnetic nickel is removed along with the paramagnetic vanadium by magneto-filtration.

Illustrative of paramagnetizing reagents which can be used to convert nickel from the diamagnetic to the paramagnetic form or state are HCN (CN— is the nucleophilic agent or solvent), and $HNO_2$ (acid).

The amount of reagent, usually is employed in a quantity so that the ratio of weight of reagent to weight of nickel in the oil, is in the range of 1:1 to 100:1, e.g., about 10:1.

The temperature of the contact of oil and reagent is usually at the existing temperature of the oil, usually in the range of 130° to 650° F., e.g., 145° F.

The pressure used is not critical and can be that at which the oil exists, normally in the range of 500 to 1500 psia, e.g., 750 psia.

The mixing or contact time between the oil and the reagent is not critical and can be 30 seconds to 10 minutes, e.g., 1 minute.

The details and features described above with respect to the first embodiment of this invention involving both the solvent stripping and the magneto-filtration are equally applicable to the second embodiment of this invention involving the conversion of diamagnetic metal contamination to paramagnetic metal contamination followed by magneto-filtration.

Hydrocarbon oils useful as the starting material in the processes of this invention generally are heavy crude oils, topped crudes, petroleum residuum oils, oils obtained from oil shales, oils obtained from tar sands and the like.

The light solvent used in the solvent extraction step preferably is a hydrocarbon solvent having 3 to 10 carbon atoms. These solvents can be normal paraffins, isoparaffins, cycloparaffins, and aromatics or mixtures thereof. Examples of such solvents are contained in the preferred group of solvents consisting of propane, butanes, pentanes, hexanes, heptanes, and mixtures thereof.

The magneto-filtration is carried out in a magneto-filtration unit which in the following will frequently be referred to by "HGMS", an abbreviation for high gradient magnetic separation. Such a HGMS unit comprises a filler chamber inside of an electromagnetic coil capable of generating a very high intensity magnetic field. In this filter chamber fine ferromagnetic elements such as steel wire sections are arranged to generate "microscopically" strong gradients of magnetic field thus causing strong magnetic forces on magnetizable, i.e., paramagnetic and ferromagnetic, materials. A method and an apparatus for magnetic separation generally is described for instance in U.S. Pat. No. 4,054,513, and in U.S. Pat. No. 4,116,829. The magnetic field used in the magneto-filtration zone generally will have a field strength of about 1 to 10 Tesla. The magnetic field intensity gradient, i.e., the change of field intensity per unit length will vary extremely in the magneto-filtration zone; the technically most meaningful way of describing this gradient is by reference to the maximum gradient, usually existing right at the surface of the ferromagnetic elements (wires). This maximum gradient will generally be in the range of 100 to 1000 Tesla/inch. The ferromagnetic elements used can have diameters in the range of 10 to 60 microns, preferably, 20 to 50 microns, e.g., stainless steel wool.

The wash solvents include such as benzene, toluene, light hydrocarbon distillates as, e.g., kerosene or the like, and also the same materials as the light solvents, above disclosed, and are non-limiting examples of wash oils.

It is presently preferred to subject the hydrocarbon oils obtained from the HGMS step (and usually after solvent removal) to a desulfurization or to a desulfurization-dinitrification operation. Particularly a catalytic hydro-desulfurization (or respectively hydro-desulfurization-denitrification) process is useful. The operation removes a major portion of the sulfur (or respectively the sulfur and nitrogen) contained in the oil product. The reduced metals content of the oil product protects the desulfurization catalyst, thus lengthening the time of use of the catalyst. The product oil from the desulfurization (or desulfurization-denitrification) operation is then finally processed in a refinery process, e.g., in a hydrocracking or a catalytic cracking process.

Further, because of the HGMS step, the solvent extraction can be operated at relatively severe conditions to produce high yield of extract. This extract then has a higher metals content. These metals are at least partially removed by the HGMS step. Thus the amount of hydrocarbon from the solvent extraction which can be charged to hydrodesulfurization and thereafter, e.g., to catalytic cracking, is increased compared to an operation without an HGMS step to produce additional valuable products, including gasoline. Therefore, the solvent extraction step may be operated so that the extract contains more than 120 ppm of metals (calculated as the metal Fe, Ni, V) or preferably even more than 150 ppm metals. Corresponding to the effluent from the HGMS step will contain less than 150 ppm metals, or even less than 120 ppm metals.

Figure 1:
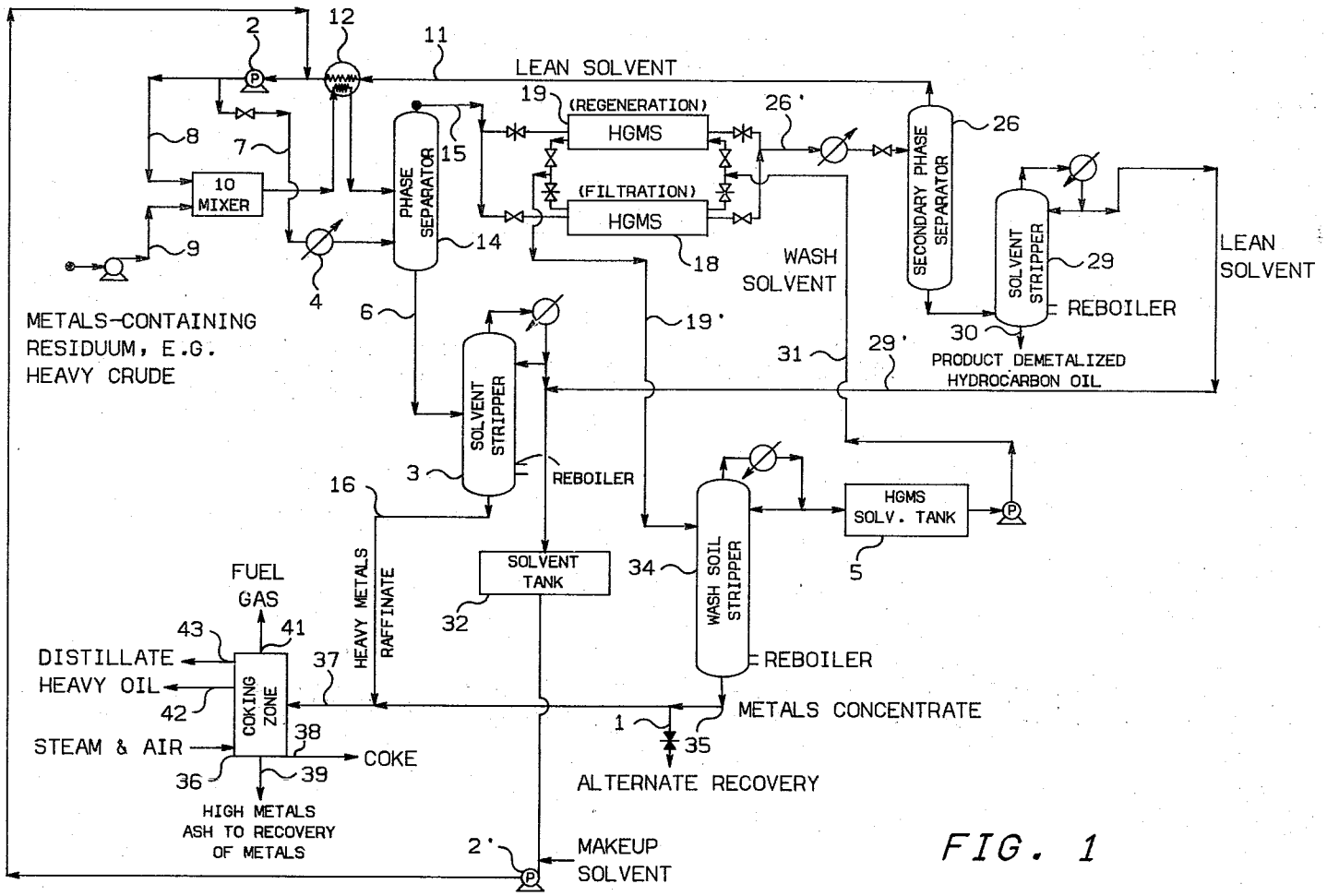
FIG. 1 illustrates the overall process.

With reference to the drawing, metals-containing heavy oil is pumped via line 9 into a mixer 10. Lean light solvent is introduced into this mixer via 8 and the mixture is passed via an indirect heat exchanger 12 to a phase separator 14. The overhead stream of this phase separator 14 comprises the lean solvent and the extracted hydrocarbons as well as some metals contamination. This lean overhead stream is passed via line 15 into the HGMS filtration unit 18 wherein the magnetizable metal contamination is removed from the stream. The purified oil stream is passed via 26' to a phase separator 26 from which an overhead lean solvent stream is withdrawn and passed via line 11 through the heat exchanger 12 and by means of a pump 2 either into the recycle line 8 and back into the mixer 10 or by means of line 7 into the phase separator 14 after having passed through a heat exchanger 4. The bottom stream of the phase separator 26 is passed to a solvent stripper 29. The overhead stream leaving the solvent stripper 29 comprises lean solvent. The bottom stream in line 30 constitutes the main product of the process, namely a purified hydrocarbon oil which is used in further downstream petroleum refining operations such as catalytic cracking.

Whereas unit 14 has been referred to as a "phase separator" it is to be understood that this vessel 14 preferably has an additional major function, namely that of extraction; the extraction begins in the mixer and goes to completion in the "phase separator". The efficiency of this extraction may be significantly enhanced by internal reflux, caused for example by an imposed temperature gradient on the length of the column 14; this gradient influences solubility. Thus, vessel 14 preferably is an extraction-phase-separation vessel.

In case the metal contamination is present in its diamagnetic form, preferably only the extract 15 is treated to convert e.g., the nickel therein into the paramagnetic state (the coordination number of Ni is thereby increased from 4 to 6) so that nickel can be removed from the oil by magneto-filter 18.

In a typical operation (not to be considered as limiting and not illustrated in the drawing), at least a portion of extract 15 is admixed with reagent HCN, to convert the nickel to the paramagnetic state, then the admixture is then passed to the magneto-filter 18, as shown in the drawing. Normally, it is not necessary to separate the reagent from the treated oil.

The bottom heavy product from the phase separator 14 comprises the asphaltenes and the large amount of metal contamination and is passed via line 6 to a solvent stripper 3. The overhead solvent stream from the solvent stripper 3 is collected in the solvent tank 32. The bottom stream from the solvent stripper 3, the heavy metals containing raffinate, is passed via line 16 to a coking zone which schematically shown in FIG. 1 under the reference numeral 36.

The lean solvent stream 29' from the solvent stripper 29 is also passed into the solvent tank 32. From this solvent tank 32 the recycle solvent and any makeup solvent is added at the suction side of pump 2'.

Two HGMS units, namely unit 18 and unit 19 are shown in the drawing. The operation is such that one unit is operated in the regeneration mode whereas the other unit operated in the filtration mode. In the regeneration mode, wash solvent is introduced into the HGMS unit 19 to be regenerated via line 31. The used wash solvent rich in metals is passed via 19' to a wash solvent stripper 34. The overhead wash solvent from this stripper 34 is passed to a solvent tank 5 and is reused as the wash solvent. The metal concentrate or wash solvent residue from the wash solvent stripper 34 is passed via line 35 to the coking zone 36. This stream can be alternately treated separately since it normally has a higher metals content than stream 16 and may have certain special uses such as metals recovery, etc.

In the coking zone 36 receiving the heavily metal contaminated heavy oils via line 37 these oils are converted into a fuel gas leaving the coking zone via line 41, into distillates leaving the coking zone via line 43, into heavy oils leaving the coking zone via line 42 and into a coke product leaving the coking zone via line 38. Furthermore, a high metals content ash is produced leaving the coking zone via 39. This ash has such a high metals content that it is useful for recovery of these metals.

Figure 2:
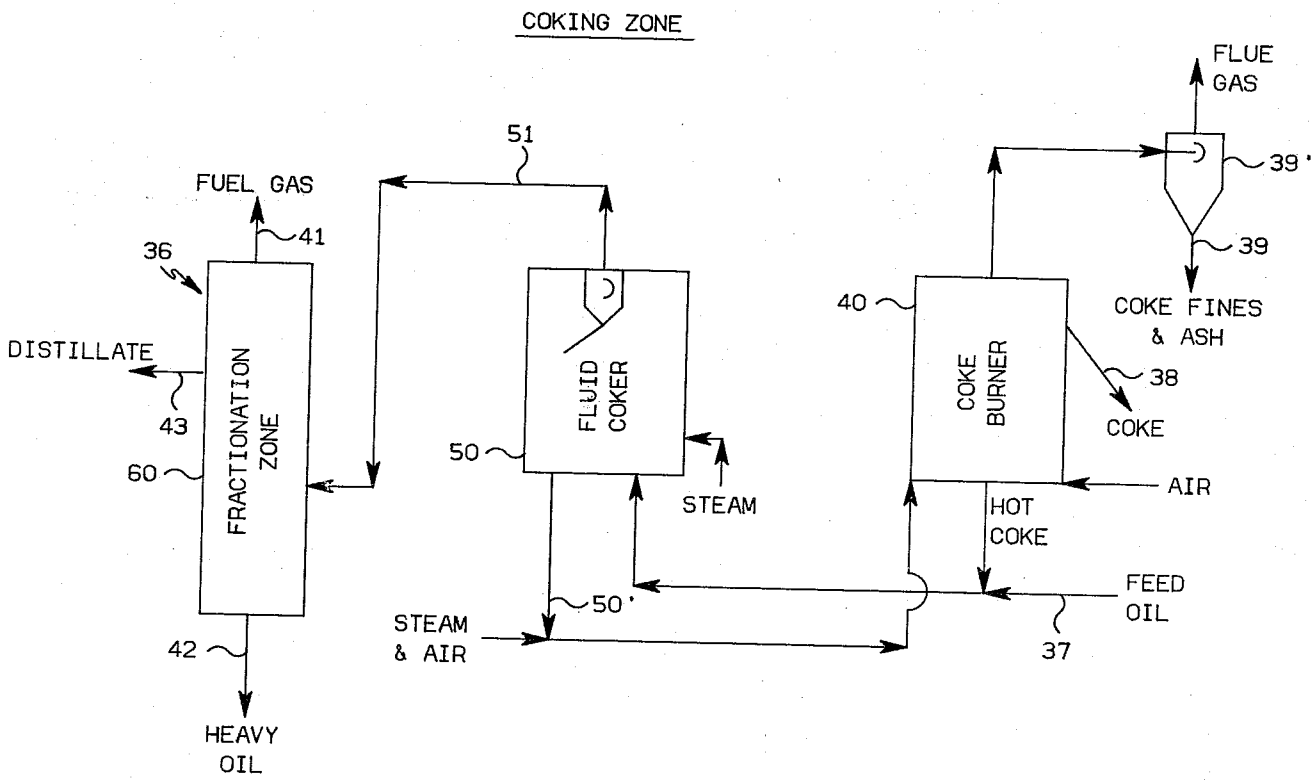
FIG. 2 illustrates the coking zone in greater detail.

The coking zone is shown in some more detail in FIG. 2. Feed oil, in this case heavy metals containing raffinate, is introduced via line 37 into the fluid coker 50 where the oil together with steam is subjected to coking conditions. Heavy solid material 50' is withdrawn from the bottom of the fluid coker 50 and introduced together with steam and air into the coke burner 40 from which coke 38 is removed and some of the hot coke that is removed from the bottom of the coke burner 40 is mixed with the feed oil to be reintroduced into the fluid coker 50. The overhead gas stream is separated in a cyclone 39' into a flue gas stream and coke fines and ash 39.

Conduit 1 allows withdrawal of a product at this locus, if desired.

The gas stream 51 from fluid coker 50 leaves through a cyclone and is introduced into a fractionation column 60 from where fuel gas is withdrawn via line 41. Distillate is withdrawn from the fractionation column 60 via line 43 and heavy oil 42 is withdrawn from the bottom of this fractionation column 60.

The overall process of this invention thus produces from a metals containing heavy oil feedstock of the following products:

demetallized hydrocarbon oil
coke
high metals ash
fuel gas
heavy oil
distillate hydrocarbons The following examples are calculated and intended to represent ranges for typical operating parameters as well as specific values for these operated parameters. These values are not intended to unduly limit the scope of this invention. In the tabulation of the example the respective units shown in the drawing are indicated by the reference numerals in parenthesis.

EXAMPLE I

In this example, estimated operation conditions and ranges for these conditions are given for a process involving supercritical extraction of a heavy metals containing oil feed using n-heptane as the solvent at a temperature and pressure above the critical temperature and pressure of the solvent.

| | Range | Specific |
|---|---|---|
| Mixer (10) | | |
| Temperature °F. | 100 to 300 | 150 |
| Pressure PSIA | 500 to 1500 | 850 |
| Exchanger-Accumulator (12) | | |
| Temperature °F. | 200 to 650 | 572 |
| Pressure PSIA | 500 to 1500 | 800 |
| Phase Separator (14) | | |
| Temperatures | | |
| Top °F. | 450 to 650 | 572 |
| Bottom °F. | 450 to 650 | 560 |
| Pressure PSIA | 500 to 1500 | 750 |
| Secondary Phase Separator (26) | | |
| Temperature °F. | 550 to 700 | 600 |
| Pressure PSIA | 350 to 700 | 400 |
| Solvent Stripper (29) | | |
| Temperatures | | |
| Top °F. | 210 to 245 | 210 |
| Bottom °F. | 350 to 550 | 400 |
| Pressure PSIA | 15 to 25 | 15 |
| Solvent Stripper (3) (Asphaltic Flash) | | |
| Temperature °F. | 450 to 700 | 500 |
| Pressure PSIA | 15 to 25 | 15 |
| Solvent Tank (32) | | |
| Temperature °F. | 70 to 110 | 80 |
| Pressure PSIA | 15 to 30 | 20 |
| HGMS on Regeneration (19) | | |
| Temperature °F. | 300 to 400 | 350 |
| Pressure PSIA | 50 to 200 | 100 |
| Coking System and Recovery (36) | | |
| Coke Burner (40) | | |
| Temperature °F. | 1050 to 1200 | 1150 |
| Pressure PSIA | 10 to 200 | 20 |
| Fluid Coker (50) | | |
| Temperature °F. | 850 to 1000 | 950 |
| Pressure PSIA | 10 to 200 | 20 |

| TYPICAL OPERATION FLOWS | |
|---|---|
| (9) Feed | |
| Barrels/hr | 750 |
| APT @ 60° F. | 12 |
| Wt. % Metals | 0.04 (400 ppm) |
| (11) N-Heptane Solvent | |
| Barrels/hr | 6,000 |
| (15) Heptane Extract to Filter (18) | |
| Barrels/hr (Includes Heptane) | 6,612 |
| (16) Raffinate | |
| Barrels/hr | 88 |
| (30) Demetallized Oil | |
| Barrels/hr | 652 |
| API @ 60° F. | 15 |
| Wt. % Metals | 0.0001–0.0005 (3 ppm) |
| (31) Toluene to Filter (19) | |
| Barrels/hr | 10 |
| (19') Backflush Yield (Absent Toluene) | |
| Barrels/hr | 10 |
| (37) Total to Coker 36 | |
| Barrels/hr | 98 |
| API @ 60° F. | <0 |
| Wt. % Metals | 0.323 (3200 ppm) |
| (41) Fuel Gas | |
| SCF/hr | 37,000 |
| BTU/SCF | 1,200 |
| (38) Coke | |
| Pounds/hr | 700 |
| (39) Ash & Fines | |
| Pounds/hr | 700 |
| Wt. % Metals | 15 |

-continued

EXAMPLE II

In the following similar to the first example, operating conditions are given for a process using propane as the solvent. It is to be noted that in this example it is contemplated that the wash fluid for the HGMS filter is toluene, so that the operating conditions for the HGMS filter on regeneration refer to toluene as the wash solvent.

| | Range | Specific |
|---|---|---|
| Mixer (10) | | |
| Temperature °F. | 80 to 150 | 100 |
| Pressure PSIA | 500 to 1500 | 750 |
| Exchanger-Accumulator (12) | | |
| Temperature °F. | 80 to 180 | 145 |
| Pressure PSIA | 500 to 1000 | 700 |
| Phase Separator (14) | | |
| Temperatures | | |
| Top °F. | 130 to 155 | 145 |
| Bottom °F. | 120 to 145 | 135 |
| Pressure PSIA | 500 to 1000 | 700 |
| HGMS on Filtration (18) | | |
| Temperature °F. | 130 to 150 | 142 |
| Pressure PSIA | 500 to 1000 | 135 |
| Magnetic Field Intensity | | |
| Gauss | 10,000 to 70,000 | 40,000 |
| Magnetic Field Gradients (estimated) | | |
| Maximum, Gauss/inch | $1 \times 10^6$ to $1 \times 10^7$ | $4 \times 10^6$ |
| Secondary Phase Separator (26) | | |
| Temperature °F. | 180 to 260 | 240 |
| Pressure PSIA | 100 to 1000 | 400 |
| Solvent Stripper (29) | | |
| Temperatures | | |
| Top °F. | 100 to 140 | 125 |
| Bottom °F. | 275 to 350 | 300 |
| Pressure PSIA | 200 to 300 | 250 |
| Solvent Stripper (34) (Asphaltic Flash) | | |
| Temperature °F. | 390 to 500 | 400 |
| Pressure PSIA | 15 to 30 | 20 |
| Solvent Tank (32) | | |
| Temperature °F. | 20 to 110 | 80 |
| Pressure PSIA | 130 to 220 | 150 |
| HGMS on Regeneration (19) | | |
| Toluene Wash Solvent | | |
| Temperature °F. | 100 to 200 | 120 |
| Pressure PSIA | 100 to 600 | 400 |
| Coking System[a] And Recovery (36) | | |
| Coke Burner (40) | | |
| Temperature °F. | 1050 to 1200 | 1150 |
| Pressure PSIA | 10 to 200 | 20 |
| Fluid Coker (50) | | |
| Temperature °F. | 850 to 1000 | 950 |
| Pressure PSIA | 10 to 200 | 20 |
| Fractionator (60) | (Conventional Conditions) | |

(a) Coking Zone 37 of this invention also utilizes conventional operating conditions and techniques as disclosed in U.S. Pat. No. 3,537,975; U.S. Pat. No. 3,162,593, and American Petroleum Institute, 1978 Proceedings—Refining Department, 43rd Midyear meeting, May 8–11, 1978, Toronto, Canada, Volume 57, page 216 through 223, U.S. Pat. No. 3,226,316 and U.S. Pat. No. 3,702,816.

| TYPICAL OPERATION FLOWS | |
|---|---|
| (9) Feed | |
| Barrels/hr | 750 |
| API @ 60° F. | 12 |
| Wt. % Metals (b) | 0.04 (400 ppm) |
| (b) Vanadium, Nickel, Iron (similar to Monagus Group 1 crude) | |
| (11) Propane Solvent | |
| Barrels/hr | 6,000 |
| (15) Propane Extract to Filter (18) | |
| Barrels/hr | 6,610 |
| (16) Raffinate | |
| Barrels/hr | 90 |
| (30) Demetallized Oil (86.7% Yield) | |
| Barrels/hr | 650 |
| API @ 60° F. | 14.5 |
| Wt. % Metals | 0.0004 (4 ppm, 1-8 ppm range) |
| (31) Toluene to Filter (19) | |
| Barrels/hr | 10 |
| (35) Backflush Yield (Absent Toluene) | |
| Barrels/hr | 10 |
| (37) Total to Coker 36 | |
| Barrels/hr | 100 |
| API @ 60° F. | <0 |
| Wt. % Metals | 0.30 (3000 ppm) |
| (41) Fuel Gas | |
| SCF/hr | 37,500 |
| Btu/SCF | 1,200 |
| (38) Coke | |
| Pounds/hr | 700 |
| (39) Ash & Fines | |
| Pounds/hr | 700 |
| Wt. % Metals | 15 |

Reasonable variations and modifications which will become apparent to those skilled in the art can be made in this invention without departing from the spirit and scope thereof.

We claim:

1. A process for demetallizing a heavy oil stream containing metals in the magnetizable form of paramagnetic molecules, paramagnetic particles or ferromagnetic particles or in the form of molecules/particles convertible to such a magnetizable form, comprising (a) contacting the heavy oil stream with a light solvent stream to obtain an extraction mixture, (b) separating said extraction mixture into an extract stream comprising solvent, extracted hydrocarbons and metals in the magnetizable form and into a residue stream having a high content of metals in the magnetizable form, (c) subjecting said extract stream to a magneto-filtering step removing a significant amount of the metals in the magnetizable form from said extract stream and yielding a demetallized extract stream.

2. Process in accordance with claim 1 wherein said demetallized extract stream is separated into a solvent stream and an oil stream.

3. Process in accordance with claim 2 wherein said separation is carried out in two steps, namely (a) a first step involving a phase separation of said demetallized extract stream into a lean solvent stream and a rich extract stream and (b) a second step subjecting said rich extract stream to a solvent stripping step resulting in an overhead solvent stream and a bottom oil stream.

4. A process in accordance with claim 1 wherein said residue stream is introduced into a coking operation as at least a portion of the feedstock, wherein the feedstock is converted to coke, hydrocarbon products, combustible gas, and metal rich ash as the products of the process.

5. A process in accordance with claim 2 wherein at least a portion of said solvent stream is passed through indirect heat exchange relationship with said extraction mixture obtained in step (a).

6. A process in accordance with claim 1 wherein said magneto-filtration step is carried out by passing said extract stream for a first period of time through a first HGMS filter under magnetic filtration conditions, thereafter passing the extract stream for a second period of time through a second HGMS filter under magnetic filtration conditions, passing a washing fluid through the HGMS filters while no extract stream is flowing through these filters and while these filters are not under HGMS filtration conditions (magnet power turned off) such as to remove accumulated metals and to regenerate said HGMS filters for repeating the filtering step in the HGMS filter and to obtain a metal rich wash fluid.

7. A process in accordance with claim 6 wherein the fluid used as said washing fluid is of the same kind as the fluid used as said light solvent.

8. A process in accordance with claim 6 comprising separating said metal rich wash fluid into a stream of lean wash fluid and a stream of wash fluid residue.

9. Process in accordance with claim 8 comprising subjecting said wash fluid residue to a coking operation as at least a portion of the feedstock wherein the feedstock is converted to coke, hydrocarbon products, fuel gas, and metal rich ash as the products of the coking step.

10. A process in accordance with claim 9 wherein both said wash fluid residue and said residue stream are subjected to the coking operation.

11. Process for demetallizing a nickel containing oil stream comprising diamagnetic nickel complexes, comprising (a) converting said diamagnetic nickel complexes in said nickel containing oil stream to paramagnetic nickel compositions, (b) removing said paramagnetic nickel compositions from said nickel containing oil stream by passing the nickel containing oil stream through a magneto-filter to obtain a demetallized extract stream.

12. A process in accordance with claim 11 comprising (a) contacting a heavy oil stream containing metals in the magnetizable form of paramagnetic molecules, paramagnetic particles or ferromagnetic particles as well as diamagnetic nickel complexes with a light solvent stream to obtain an extraction mixture, (b) separating said extraction mixture into an extract stream comprising solvent, extracted hydrocarbons, metals in the magnetizable form and diamagnetic nickel complexes and into a residue stream having a high content of metals, wherein said extract stream constitutes the nickel-containing oil stream, and passing said nickel-containing oil stream to step (a) of claim 11.

13. A process in accordance with claim 12 wherein said demetallized extract stream is separated into a solvent stream and an oil stream.

14. A process in accordance with claim 13 wherein said separation is carried out in two steps, namely (a) a first stream involving a phase separation of said extract stream into a lean solvent stream and a rich extract stream, and (b) a second step subjecting said rich extract stream to a solvent stripping step resulting in an overhead solvent stream and a bottom oil stream.

15. A process in accordance with claim 12 wherein said residue stream is introduced into a coking operation as at least a portion of the feedstock wherein the feedstock is converted into coke, hydrocarbon products, fuel gas, and metal rich ash as the products of the process.

16. Process in accordance with claim 13 wherein at least a portion of said solvent stream is passed through indirect heat exchange relationship with said extraction mixture.

* * * * *